US008263885B2

(12) United States Patent
Yamamoto

(10) Patent No.: US 8,263,885 B2
(45) Date of Patent: Sep. 11, 2012

(54) SWITCH DEVICE

(75) Inventor: Masahiro Yamamoto, Kasugai (JP)

(73) Assignee: OMRON Corporation, Kyoto (JP)

( * ) Notice: Subject to any disclaimer, the term of this patent is extended or adjusted under 35 U.S.C. 154(b) by 417 days.

(21) Appl. No.: 12/704,387

(22) Filed: Feb. 11, 2010

(65) Prior Publication Data

US 2010/0206705 A1 Aug. 19, 2010

(30) Foreign Application Priority Data

Feb. 16, 2009 (JP) ..... 2009-032563

(51) Int. Cl.
*H01H 9/04* (2006.01)

(52) U.S. Cl. ..... 200/302.1; 340/5.62; 307/10.4

(58) Field of Classification Search ..... 200/341, 200/302.1, 294, 296; 340/5.62, 5.72; 307/10.2–10.4
See application file for complete search history.

(56) References Cited

U.S. PATENT DOCUMENTS 4,968,862 A * 11/1990 Maeda ..... 200/306
5,836,187 A * 11/1998 Janssen et al. ..... 70/252
7,187,266 B2 * 3/2007 Hasegawa et al. ..... 340/5.62
7,227,447 B2 * 6/2007 Ohtaki et al. ..... 340/5.62
7,838,784 B2 * 11/2010 Arisaka et al. ..... 200/302.1
2004/0256204 A1 * 12/2004 Suzuki et al. ..... 200/43.03

FOREIGN PATENT DOCUMENTS

JP 10-205183 A 8/1998

* cited by examiner

*Primary Examiner* — Felix O Figueroa
(74) *Attorney, Agent, or Firm* — Osha • Liang LLP

(57) ABSTRACT

A switch device has a slider that advances and retreats in a front-back direction, a push button that is integrally provided at a front end of the slider, a switch contact whose on and off states are switched according to an operation for pushing down the push button to cause the slider to retreat, a biasing member that biases the slider in an advancing direction in order to return the push button and the slider to a non-manipulated position, a case in which the switch contact, the biasing member, and the slider are assembled, the push button being disposed in an opening at a front end of the case, a front-portion constituent member that is attached to the case while disposed around the push button in the opening, and a coil that is wound around a bobbin formed in an outer circumference of the front-portion constituent member.

2 Claims, 8 Drawing Sheets

C-C SECTION

NEUTRAL STATE

C-C SECTION

FULL-STROKE STATE

C-C SECTION

D-D SECTION

F-F SECTION

SWITCH DEVICE

BACKGROUND OF THE INVENTION

1. Technical Field

The present invention relates to a switch device suitable for starting a vehicle engine.

2. Related Art

Recently a type of vehicle, in which a user does not conventionally insert a key in a key cylinder to turn the key, but the user having a proper electronic key starts up an engine only by pressing a push button of an engine starting switch device provided on a driver seat on a condition that the vehicle is equipped with an authentication system such as a so-called immobilizer, has become widespread in vehicles such as a four-wheeled vehicle. Japanese Unexamined Patent Publication No. 10-205183 discloses an automotive key cylinder in which a drain property is considered. In the automotive key cylinder disclosed in Japanese Unexamined Patent Publication No. 10-205183, a drain hole is made in a lower portion on a front-end side of a case, and a liquid (such as rain water) invading in a cylinder head from a key plate hole is drained away from the drainage hole to the outside of the case.

SUMMARY

There has been proposed that a coil antenna is provided as an emergency antenna in an outer circumferential portion (around the push button) at a front end of the switch device when normal wireless communication for verification cannot be conducted between the electronic key and an antenna of the in-vehicle controller for immobilizer because a battery for the immobilizer electronic key is consumed.

However, when the coil antenna is simply provided in the outer circumferential portion at a front end of the switch device to make the drain hole in a lower portion at the front end of the case of the switch device, possibly a lead constituting the coil antenna can be visually recognized from the drain hole in a state of the single switch device, and it is undesirable from a viewpoint of security.

One or more embodiments of the present invention avoids security degradation caused by visually recognizing the coil from the outside of the switch device while a drain property of the liquid invading from a gap of the outer circumference of the push button is maintained in the switch device in which a coil is disposed around the push button of the front-end portion.

In accordance with one aspect of the present invention, there is provided a switch device including: a slider that advances and retreats in a front-back direction; a push button that is integrally provided at a front end of the slider; a switch contact whose on and off states are switched according to an operation for pushing down the push button to cause the slider to retreat; a biasing member that biases the slider in an advancing direction in order to return the push button and the slider to a non-manipulated position; a case in which the switch contact, the biasing member, and the slider are assembled, the push button being disposed in an opening at a front end of the case; a front-portion constituent member that is attached to the case while disposed around the push button in the opening; and a coil that is wound around a bobbin formed in an outer circumference of the front-portion constituent member, wherein a drain that causes a liquid to flow down to a lower portion on a rear side of the bobbin through an inside of the bobbin is formed in the front-portion constituent member, the liquid invading from a gap between an outer circumference of the push button and the front-portion constituent member, and a drain port that is joined to and communicated with a lower-end opening of the drain with no gap therebetween is formed on a bottom surface side of the case, and at least the coil cannot be visually recognized from the drain port.

In the switch device according to one or more embodiments of the present invention, the coil bobbin is formed in the outer circumference of the front-portion constituent member, the drain that causes the liquid to flow down to the lower portion on the rear side of the bobbin through the inside of the bobbin is formed in the front-portion constituent member, the liquid invading from the gap between the outer circumference of the push button and the front-portion constituent member, the drain port that is joined to and communicated with the lower-end opening of the drain with no gap therebetween is formed on the bottom surface side of the case, and at least the coil cannot be visually recognized from the drain port. Therefore, the security degradation caused by visually recognizing the coil from the outside of the switch device can be avoided while the drain property of the liquid invading from the gap of the outer circumference of the push button is maintained.

In a switch device according to one or more embodiments of the present invention, a circuit board to which the switch contact and the coil are connected is provided in the case, and the circuit board and the switch contact cannot be visually recognized from the drain port. In this case, the security degradation caused by visually recognizing the circuit board and the switch contact from the outside of the switch device can be avoided.

In the switch device according to one or more embodiments of the present invention, the security degradation caused by visually recognizing the coil provided in the outer circumferential portion (around the push button) at the front end of the switch device from the outside of the switch device can be avoided while the drain property of the liquid invading from the gap of the outer circumference of the push button is maintained.

BRIEF DESCRIPTION OF THE DRAWINGS

FIG. 7A illustrates a state in which a lower plate is mounted, FIG. 7B illustrates a state in which the lower plate is not mounted.

DETAILED DESCRIPTION

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. Hereinafter, a first embodiment of the present invention will be described with reference to the drawings.

Figure 1A:
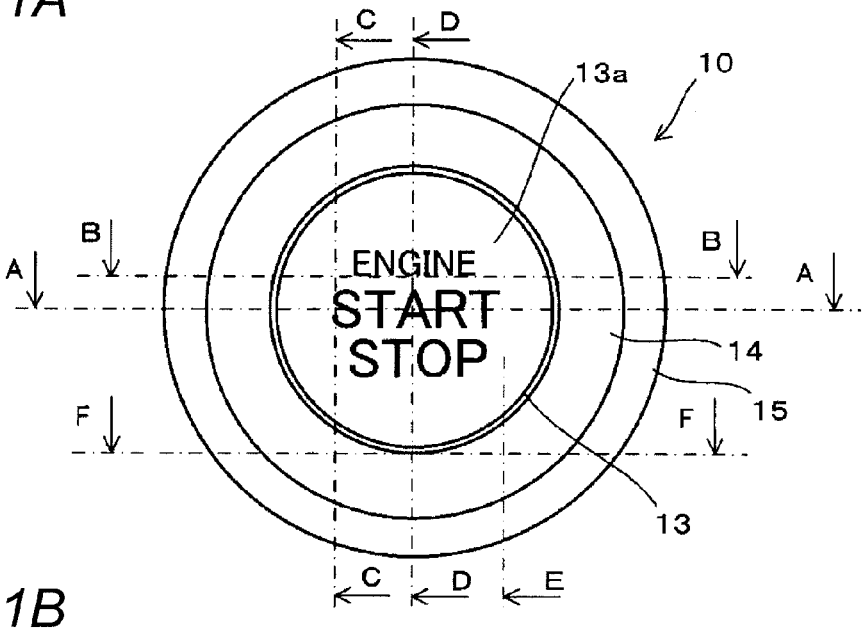
FIG. 1A is a front view of a switch device.
Figure 1B:
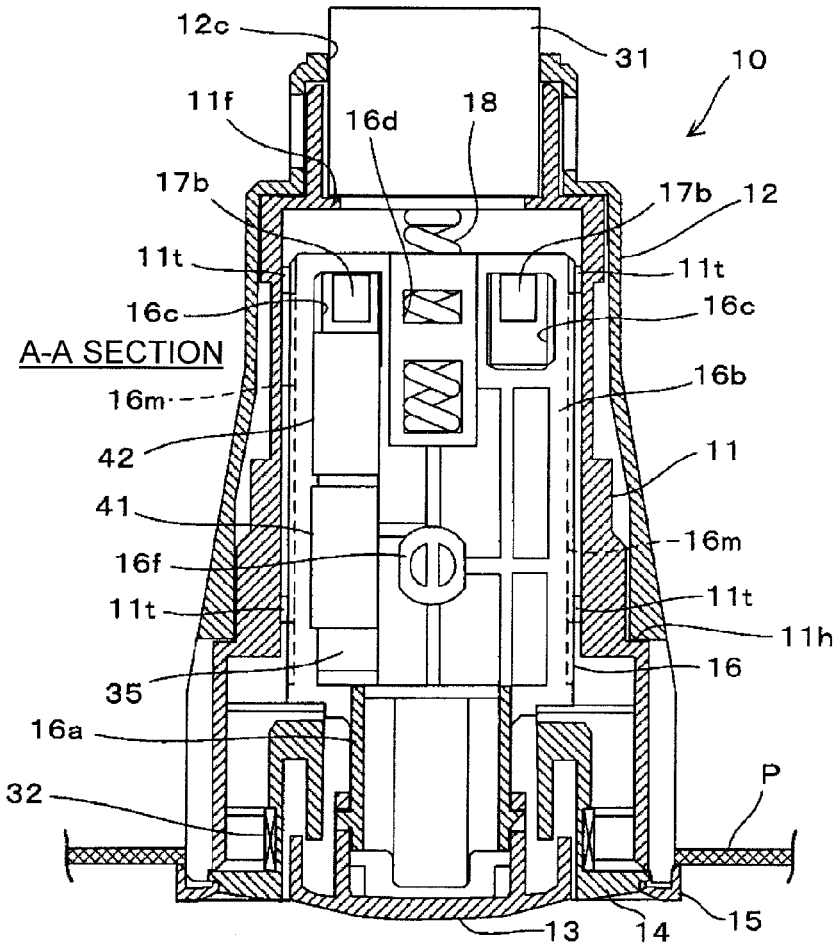
FIG. 1B is a sectional view taken along line A-A of FIG. 1A.
Figure 2A:
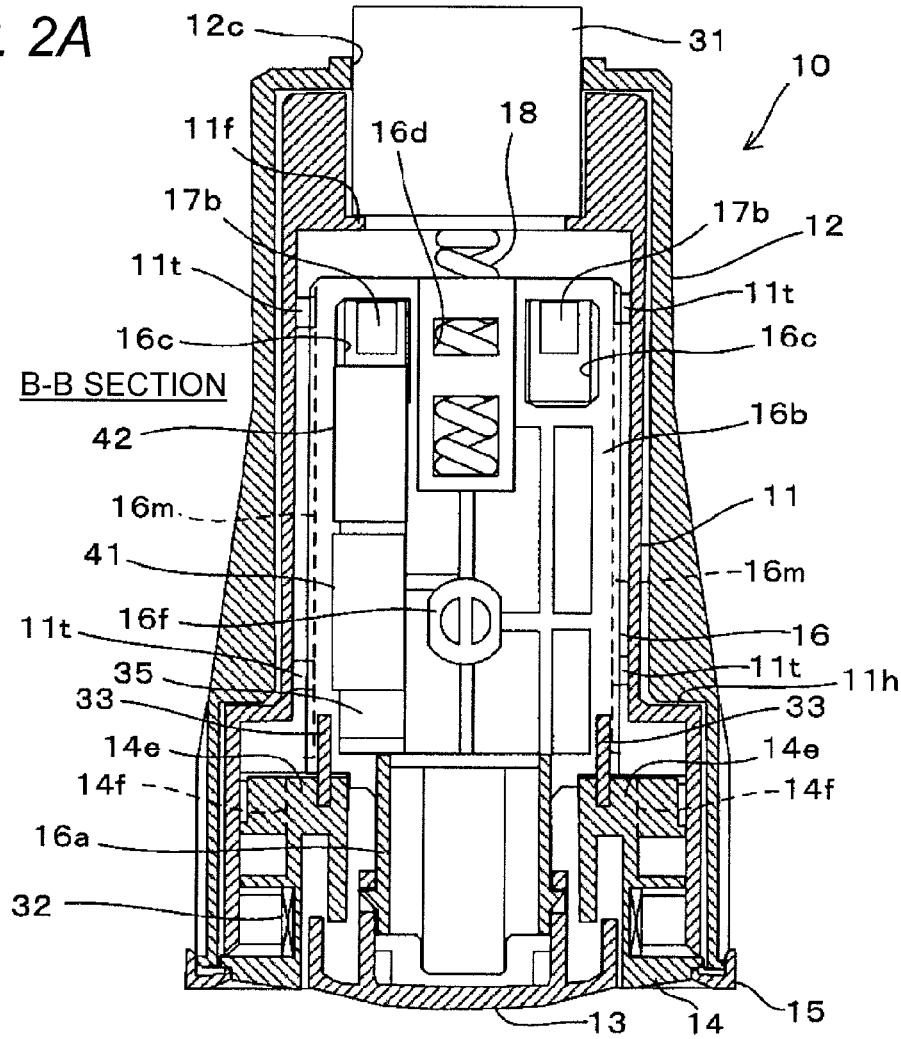
FIG. 2A is a sectional view taken along line B-B of the switch device of FIG. 1A.
Figure 2B:
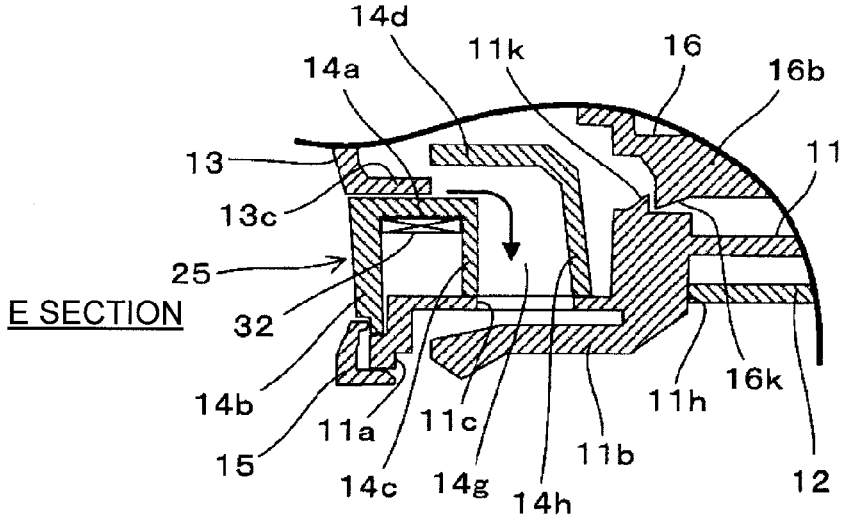
FIG. 2B is a sectional view taken along line E of the switch device of FIG. 1A.
Figure 3:
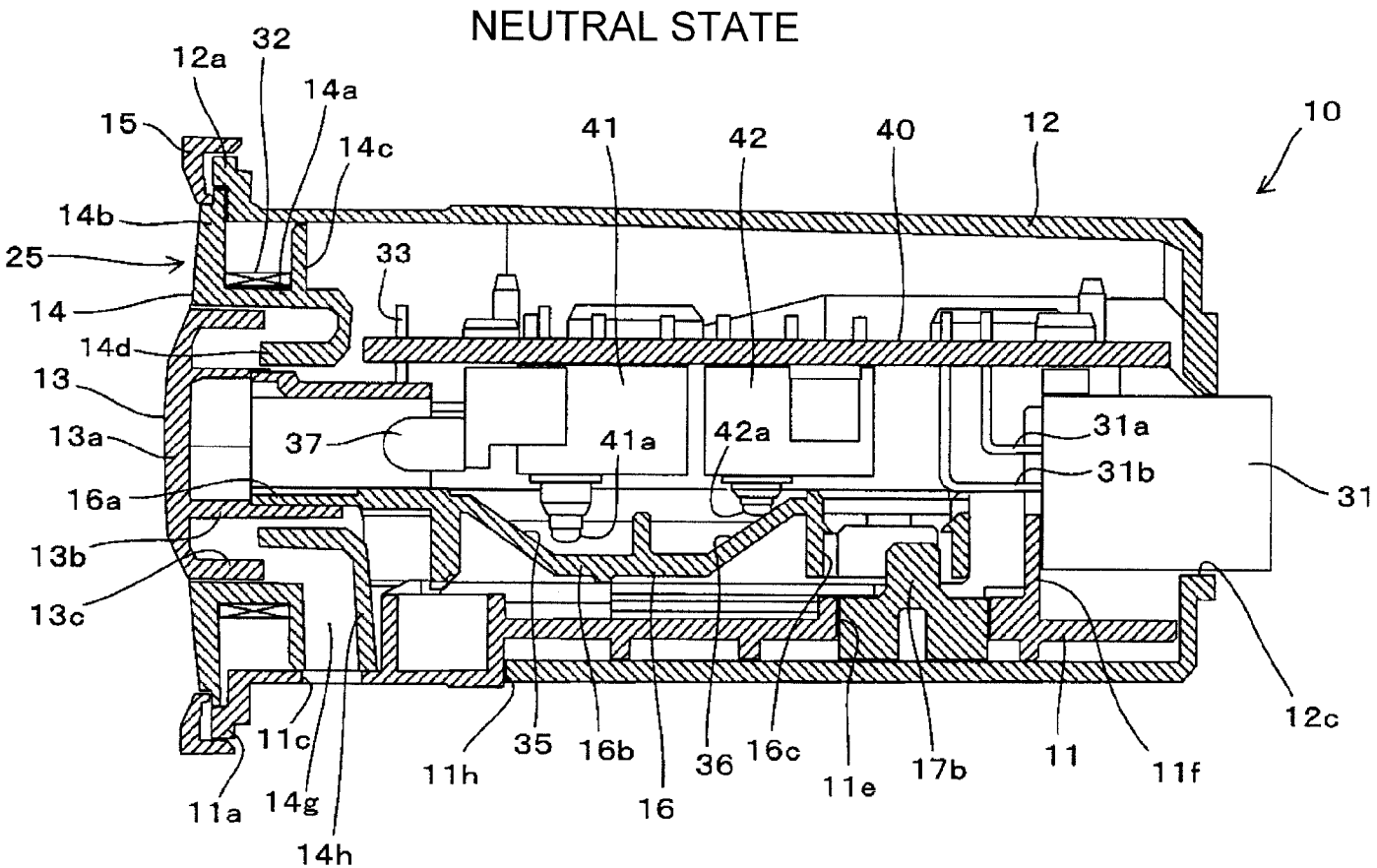
FIG. 3 is a sectional view taken along line C-C of the switch device (neutral state) of FIG. 1A.
Figure 4:
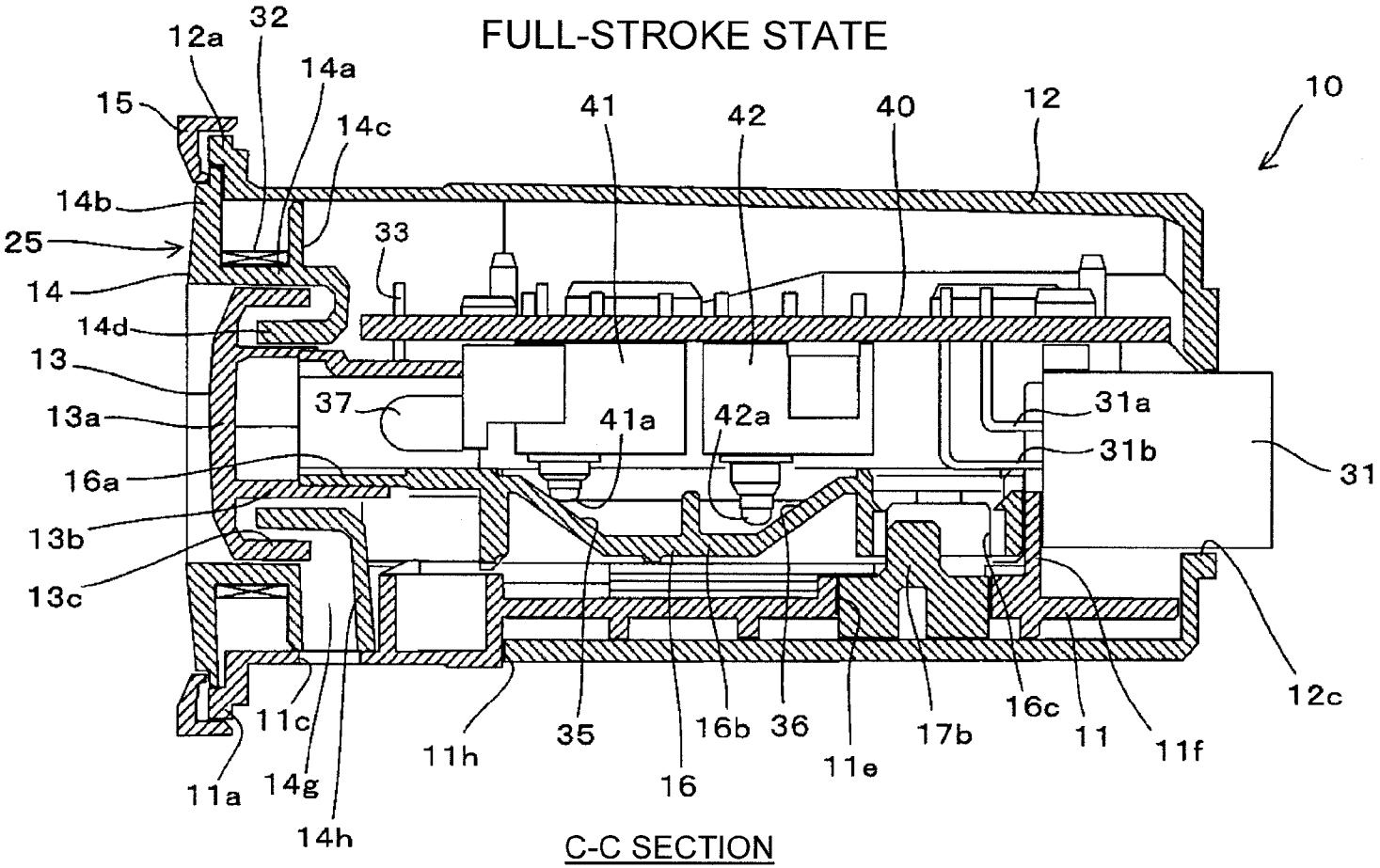
FIG. 4 is a sectional view taken on the line C-C of the switch device (full-stroke state) of FIG. 1A.
Figure 5:
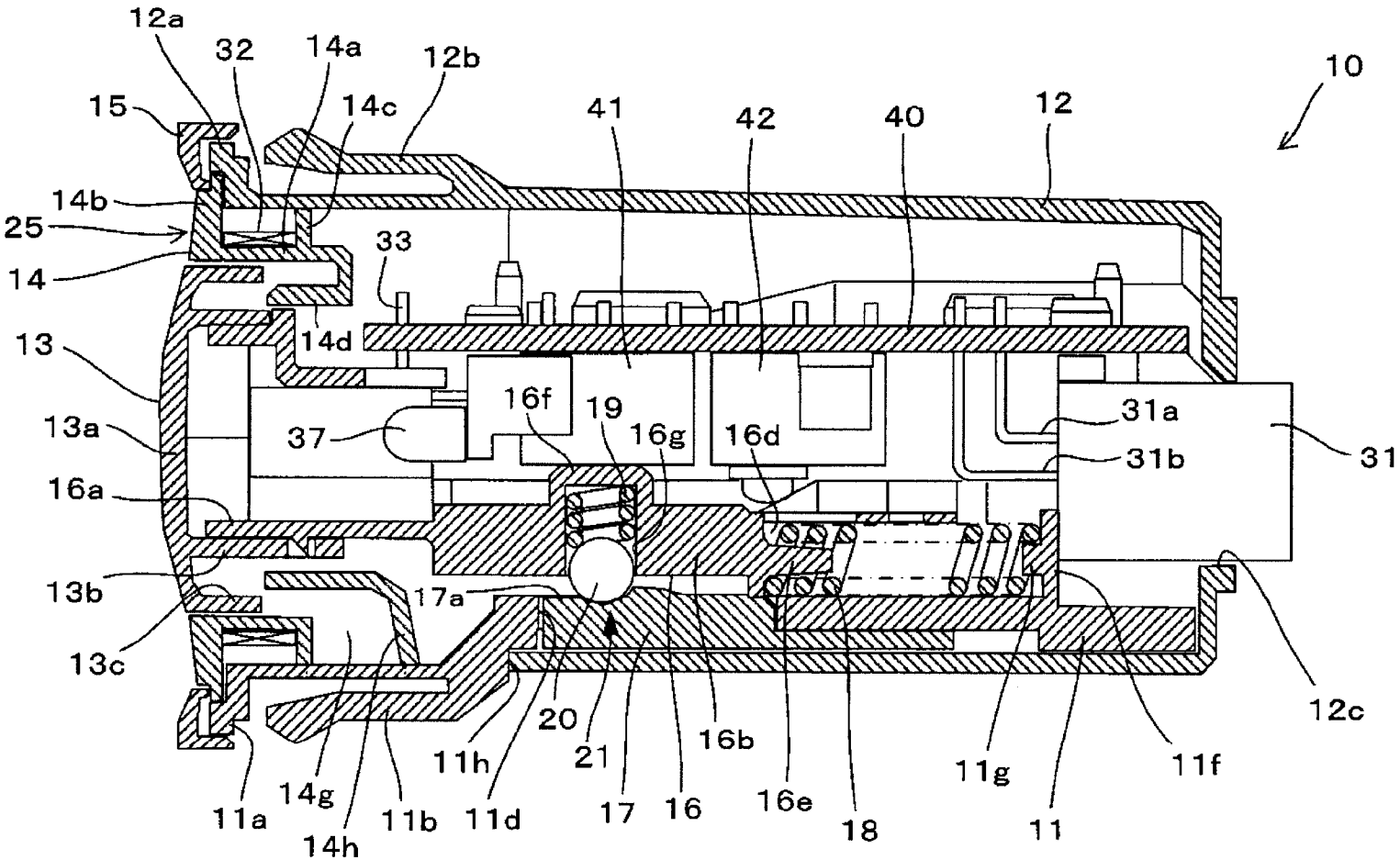
FIG. 5 is a sectional view taken along line D-D of the switch device of FIG. 1A.
Figure 6A:
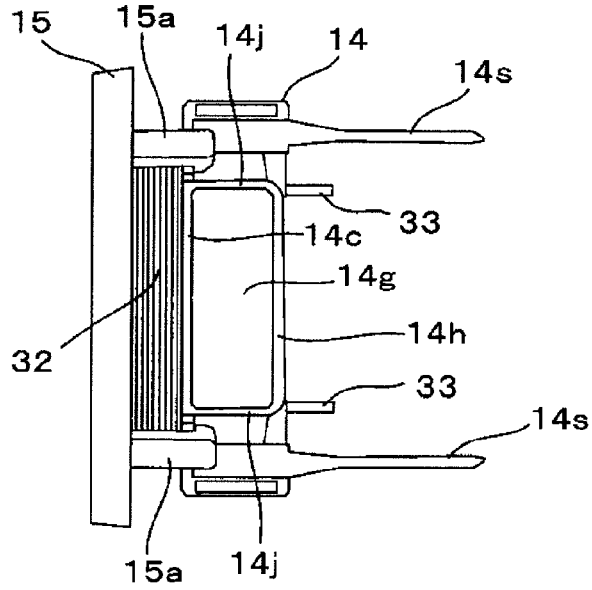
FIG. 6A is a bottom view of a front-portion constituent member (including a front-face circumferential member)
Figure 6B:
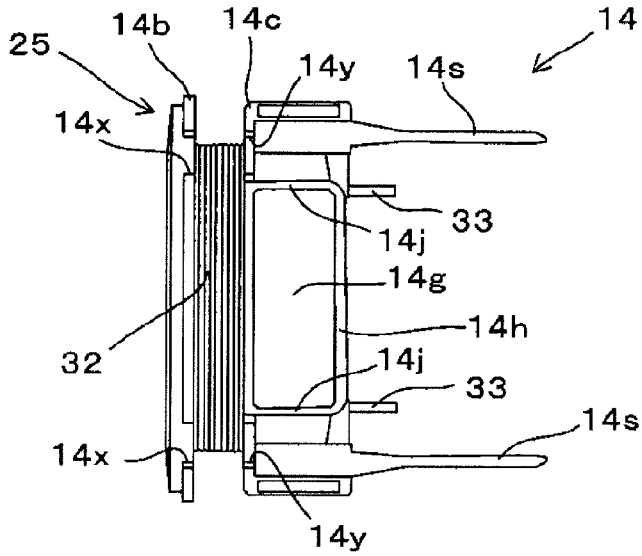
FIG. 6B is a bottom view of the front-portion constituent member.
Figure 6C:
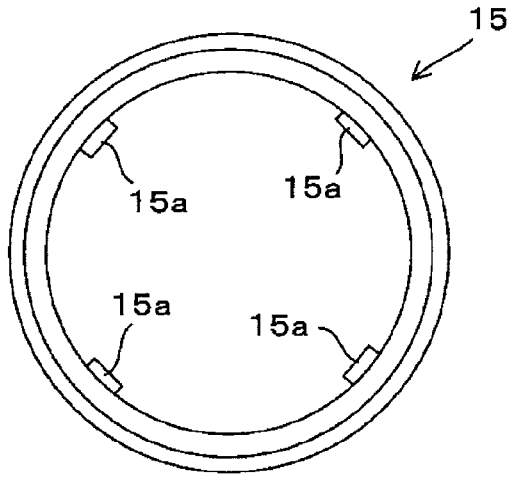
FIG. 6C is a front view of the front-face circumferential member.
Figure 7A:
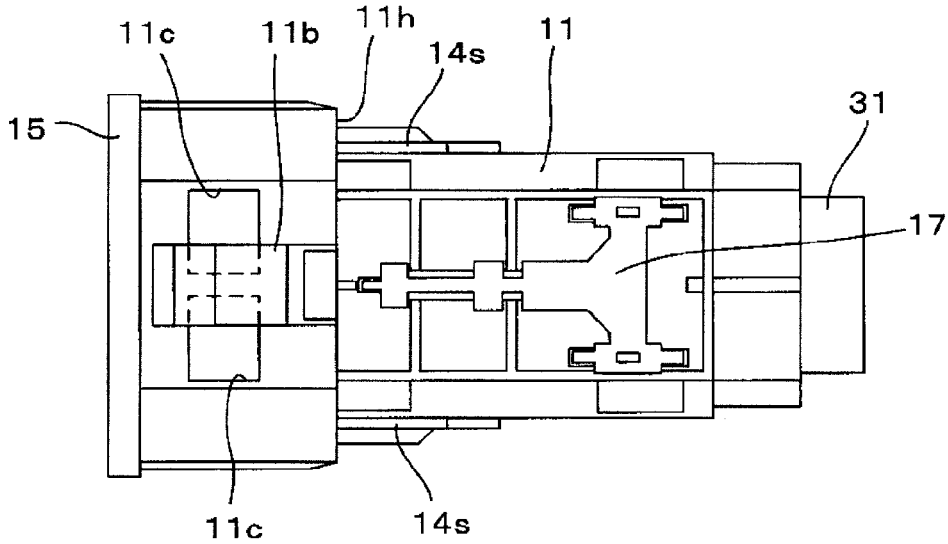
FIGS. 7A and 7B are bottom views of the switch device in which a second case is removed.
Figure 7B:
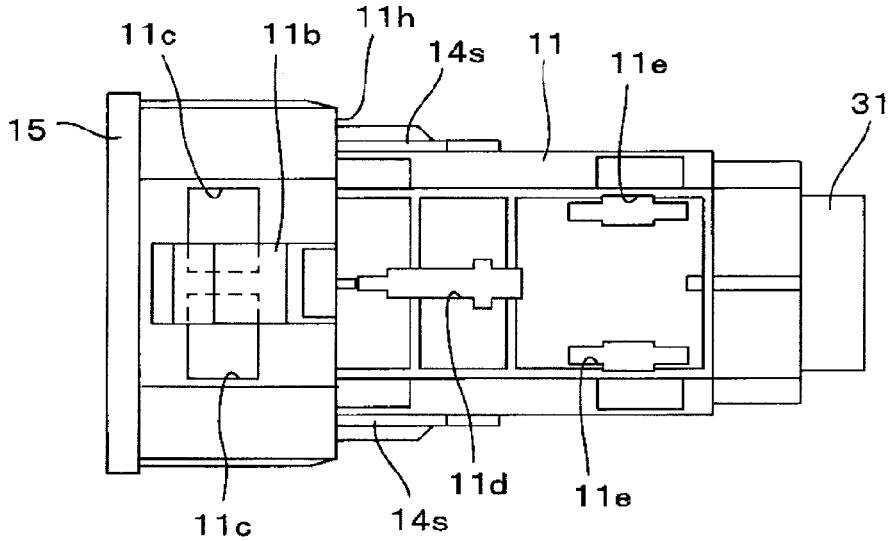
Figure 7C:
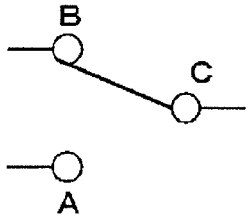
FIG. 7C illustrates a configuration example of a contact.
Figure 8:
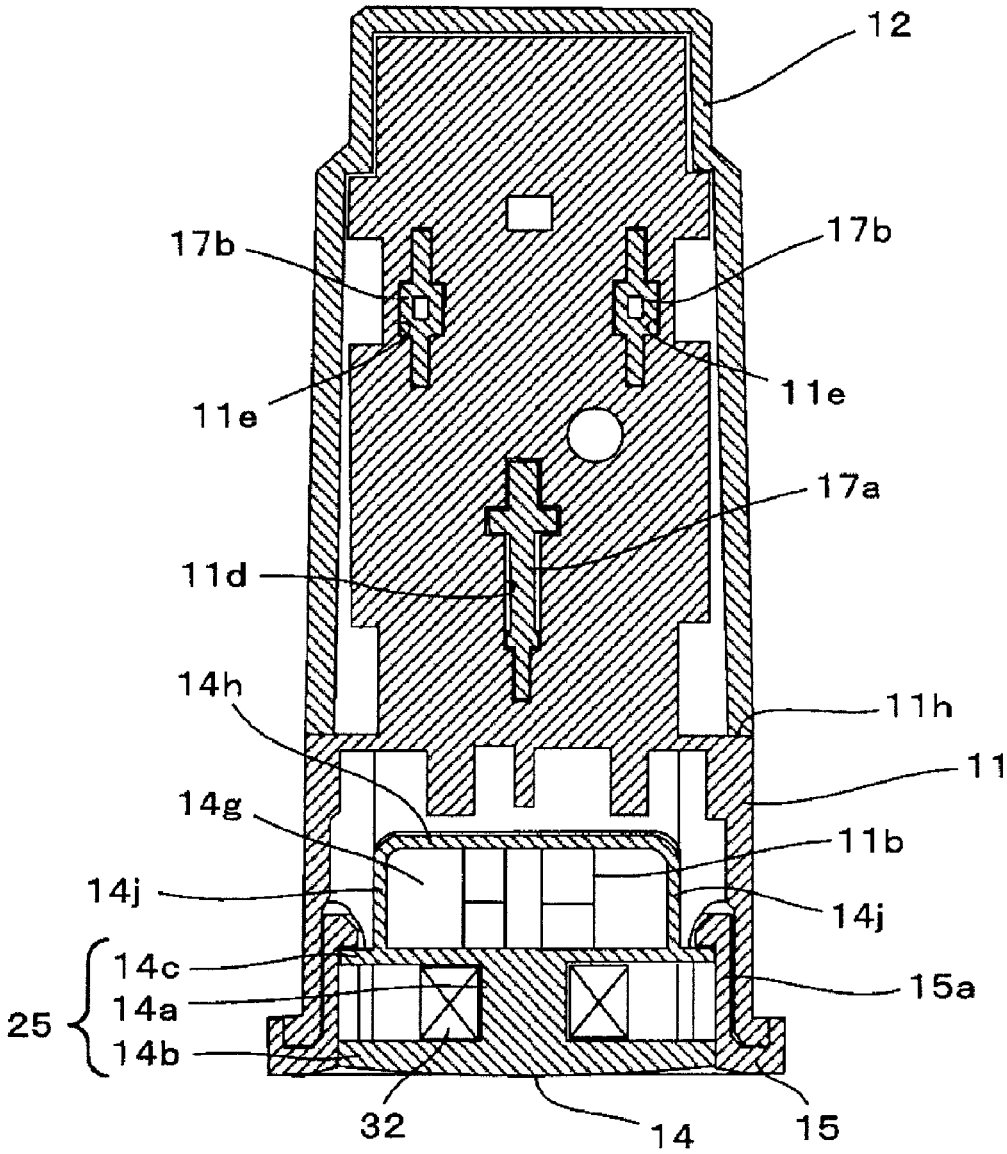
FIG. 8 is a sectional view taken along line F-F of the switch device of FIG. 1A.

FIGS. 1A to 8 are views for describing a structure and components of a switch device 10 according to this embodiment. FIG. 1A is a front view of the switch device 10, and FIG. 1B is a horizontal sectional view (sectional view taken along line A-A of FIG. 1A). FIG. 2A is a horizontal sectional view of the switch device 10 (sectional view taken along line B-B of FIG. 1A), and FIG. 2B is a partial sectional side view of the switch device 10 (sectional view taken along line E of FIG. 1A). FIGS. 3 and 4 are sectional side views of the switch device 10 (sectional view taken along line C-C of FIG. 1A), FIG. 3 illustrates a neutral state (non-manipulated state), and FIG. 4 illustrates a full-stroke state (manipulated state in which a push button is pressed at a maximum). FIG. 5 is a sectional side view of the switch device 10 (sectional view taken along line D-D of FIG. 1A). FIGS. 6A and 6B illustrate a front-portion constituent member 14 (including a coil antenna 32) described below, where FIG. 6A is a bottom view illustrating a state in which a front-face circumferential member 15 is mounted on the front-portion constituent member 14, FIG. 6B is a bottom view illustrating a state in which the front-face circumferential member 15 is removed from the front-portion constituent member 14, and FIG. 6C is a front view of the front-face circumferential member 15. FIGS. 7A and 7B are bottom views of the switch device 10 in which a second case 12 is removed, where FIG. 7A illustrates a state in which a lower plate 17 is mounted, FIG. 7B illustrates a state in which the lower plate 17 is removed, and FIG. 7C illustrates a configuration example of a contact of switch bodies 41 and 42. FIG. 8 is a horizontal sectional view of the switch device 10 (sectional view taken along line F-F of FIG. 1A).

Hereinafter, a direction orthogonal to a paper plane in FIG. 1A is referred to as a front-back direction, a right-and-left direction in FIG. 1A is referred to as a horizontal direction, and an up-and-down direction in FIG. 1A is referred to as a vertical direction. Therefore, for example, the vertical direction in FIG. 1B becomes the front-back direction. Hereinafter, a downward direction in FIG. 1B is referred to as a front direction, and a leftward direction in FIG. 1B is referred to as a leftward direction.

As illustrated in FIG. 5, the switch device 10 is long and thin in the front-back direction as a whole, and the switch device 10 includes a first case 11, a second case 12, a push button 13, a front-portion constituent member 14, a front-face circumferential member 15, a slider 16, a lower plate 17, a return spring 18, a crisp feel spring 19, a crisp feel ball 20, a connector 31, a coil antenna 32, a circuit board 40, and switch bodies 41 and 42. In this case, the crisp feel spring 19 and the crisp feel spring 20 constitute a crisp feel generating mechanism 21.

In FIG. 1B, the switch device 10 is mounted on a panel wall P of the vehicle driver seat. As illustrated in FIG. 1B, the whole of the switch device 10 is substantially disposed inside the panel wall P while only a front surface side such as the push button 13 is exposed at the front.

The first case 11 is a molded component of synthetic resin, a bottom surface of the switch device 10 and a substantially lower half (mainly portion below a height of a circuit board 40) of a side face of the switch device 10 are covered with the first case 11, and an upper surface of the switch device 10 is opened. A lower half 11*a* of a flange (collar portion) is formed at a front end of the first case 11 in order to mount the front-face circumferential member 15. A latch piece 11*b* is formed in a front-side bottom surface of the first case 11 so as to be extended frontward, and the latch piece 11*b* is used for mounting the switch device 10 on the vehicle driver seat panel. Two drain ports 11*c* (see FIGS. 3, 7A and 7B) are provided on both sides in the horizontal direction of the latch piece 11*b* in a front-side bottom portion of the first case 11.

The drain port 11*c* is joined to and communicated with a drain 14*g* described below with no gap therebetween (see FIG. 2B). That is, a peripheral portion of the drain port 11*c* in the first case 11 and a wall (such as a drain rear wall portion 14*h* described below) surrounding the drain 14*g* are joined with no gap therebetween, only the inside of the lower end of the drain 14*g* can be visually recognized even if a person looks the inside of the switch device 10 through the drain port 11*c* from the outside of the switch device 10, and the person cannot visually recognize portions (particularly coil antenna 32, circuit board 40, and switch bodies 41 and 42) except for the inside of the lower end of the drain 14*g*.

An opening 11*d* is formed in a central bottom portion of the first case 11 in order that a ball contact portion 17*a* of the lower plate 17 is mounted from below and exposed to the inside (upward direction). Openings 11*e* (see FIG. 3) are formed on both sides in the horizontal direction of a back-side bottom portion of the first case 11 in order to pierce a stopper portion 17*b* of the lower plate 17 from below toward the inside (upward direction). A partition wall 11*f*, to which the front-end surface of the connector 31 is joined, is formed in the back-side bottom portion of the first case 11 so as to be extended upward. As illustrated in FIG. 5, a projection 11*g* is formed in a lower front face of the partition wall 11*f*, and the projection 11*g* is inserted in a back end of the return spring 18 to position the back end of the return spring 18. A step 11*h* is formed at a predetermined position (position on a back side of a base of the latch piece 11*b*) of an outer circumference of the first case 11 in order to join a lower portion of a front end face of the second case 12.

The return spring 18 and the slider 16, which are biasing members, are assembled inside the first case 11, and a guiding mechanism is provided between the slider 16 and the first case 11. The guiding mechanism has enough length to smoothly guide the slider 16 only in the front-back direction. In this embodiment, as illustrated in FIG. 1B, guide grooves 16*m* in the front-back direction are formed in side faces on both sides of a plate-like portion 16*b* (described below) of the slider 16 over the substantially total length of the plate-like portion 16*b*. On the other hand, in an internal surface of the first case 11 facing the plate-like portion 16*b*, guide projections 11*t* are provided at two positions in the front-back direction so as to be slidably fitted in the guide groove 16*m*, and the guide projections 11*t* and the guide grooves 16*m* constitute the guiding mechanism. Although not illustrated, a similar guiding mechanism is provided between the bottom surface of the slider 16 and the bottom surface of the first case 11.

As illustrated in FIG. 2B, a temporarily-jointing engagement projection 11*k* is formed at a relatively front side right position in the bottom portion of the first case 11. While the lower plate 17 is not mounted on the first case 11, the temporarily-jointing engagement projection 11*k* engages a temporarily-jointing engagement projection 16*k* (described below) of the slider 16 to prevent the slider 16 from moving in a return direction (in this case, the frontward direction) such that the slider 16 does not drop out from the first case 11 by a biasing force of the return spring 18.

The second case 12 is a synthetic resin molded product, and substantially the whole surface except for the front face of the switch device 10 is covered with the second case 12. The second case 12 is mounted such that the whole outer surface of the first case 11 except for the lower half of the portion in front of the step 11*h* is covered with the second case 12. The second case 12 is attached to the first case 11 by a latch portion (not illustrated) so as to be integral with the first case 11. As illustrated in FIG. 5, an upper half 12*a* of the flange is formed at a front end of the second case 12 in order to mount the front-face circumferential member 15. A latch piece 12*b* (the latch piece 12*b* and the latch piece 11*b* are disposed in pairs) is formed in a front-side bottom surface of the second case 12 so as to be extended frontward, and the latch piece 12*b* is used for mounting the switch device 10 on the vehicle driver seat panel. An opening 12*c* is formed in a back-end wall of the second case 12 in order to backwardly project a rear portion of the connector 31. As illustrated in FIG. 5, because the second case 12 is provided such that the bottom surface side of the lower plate 17 is covered with the second case 12 with a slight gap in an assembled state, the lower plate 17 cannot be removed as long as the second case 12 is removed. Therefore, the second case 12 also exerts a function of preventing the drop-out of the lower plate 17.

The push button 13 is a synthetic resin molded product, and the push button 13 is formed into a cap shape in which an inner cylindrical portion 13*b* and an outer cylindrical portion 13*c* are formed on a back side of a front-face wall 13*a*. The push button 13 is disposed inside the front-portion constituent member 14 and attached to a leading end of the slider 16, and the push button 13 is moved in the front-back direction while being integral with the slider 16. As illustrated in FIGS. 5 and 1A, the front-face wall 13*a* of the push button 13 is disposed while facing the center of the front surface of the switch device 10 such that a user (for example, vehicle driver) can press the push button 13 with a finger (that is, the front-face wall 13*a* of the push button 13 is disposed while facing the center of the opening on the front-end side of the case including the first case 11 and the second case 12). In the front-face wall 13*a* of the push button 13, characters are formed in the front face so as to clearly specify the button for starting (and stopping) the engine.

The front-portion constituent member 14 is a synthetic resin molded product, and the front-portion constituent member 14 includes an outer cylindrical portion 14*a*, a front wall portion 14*b*, a rear wall portion 14*c*, and an inner cylindrical portion 14*d*. The outer cylindrical portion 14*a* is disposed in concentric with the outer cylindrical portion 13*c* of the push button 13 along the outer circumference of the push button 13. The front wall portion 14*b* is formed into a collar shape so as to be radially extended outward from a front-end outer circumference of the outer cylindrical portion 14*a*. The rear wall portion 14*c* is formed into the collar shape so as to be radially extended from a back-end-side outer circumference of the outer cylindrical portion 14*a*. The inner cylindrical portion 14*d* is formed into a U-shape in section so as to be extended inward from the back end of the outer cylindrical portion 14*a*. As illustrated in FIGS. 6A and 6B, the front-portion constituent member 14 includes latch pieces 14*s* on both sides in the horizontal direction, and the latch piece 14*s* is formed so as to be extended backward from the side-portion back end of the outer cylindrical portion 14*a*. Leading-end sides of the latch pieces 14*s* are projected through the step 11*h* of the first case 11 (see FIG. 7A), and the leading-end sides of the latch pieces 14*s* are latched in a latch portion (not illustrated) formed at the back of the step 11*h* in the external surface of the first case 11, whereby the latch pieces 14*s* are integrally attached to the first case 11.

The portion from the position of the front wall portion 14*b* in the outer cylindrical portion 14*a* to the position of the rear wall portion 14*c*, the front wall portion 14*b*, and the rear wall portion 14*c* constitute a bobbin 25 around which a wire of a coil constituting the coil antenna 32 is wound.

The inner cylindrical portion 13*b* and outer cylindrical portion 13*c* of the push button 13 and the outer cylindrical portion 14*a* and inner cylindrical portion 14*d* of the front-portion constituent member 14 are concentrically disposed in relation to one center line in the front-back direction. In the radial direction in relation to the center line, the inner cylindrical portion 13*b* of the push button 13 is disposed inside the inner cylindrical portion 14*d* of the front-portion constituent member 14, the outer cylindrical portion 13*c* of the push button 13 is disposed between the outer cylindrical portion 14*a* and inner cylindrical portion 14*d* of the front-portion constituent member 14, and the push button 13 can be slid in the front-back direction with respect to the front-portion constituent member 14.

The leading end of the inner cylindrical portion 14*d* of the front-portion constituent member 14 is formed so as to be extended frontward along the outer cylindrical portion 14*a*. As illustrated in FIG. 4, when the push button 13 is pushed down, the leading end of the inner cylindrical portion 14*d* invades between the inner cylindrical portion 13*b* and outer cylindrical portion 13*c* of the push button 13.

As illustrated in FIG. 3, in the assembled state, the outer circumference of the bobbin 25 is covered with the first case 11 and second case 12 with no gap therebetween, the coil antenna 32 is disposed in a basically closed space (that is, a space surrounded by the first case 11, the second case 12, and the outer cylindrical portion 14*a*, front wall portion 14*b*, and rear wall portion 14*c* of the front-portion constituent member 14) with the exception of a coil wire lead groove 14*f* (described below) and the like.

A coil terminal support portions 14*e* (see FIG. 2A) are formed on both sides in the horizontal direction at the back end of the front-portion constituent member 14 so as to be projected backward. A metal coil terminal 33 is fixed to the coil terminal support portion 14*e* by insert molding. One end of the coil terminal 33 is extended upward from the coil terminal support portion 14*e* and connected to the circuit board 40, and the other end is extended backward from the coil terminal support portion 14*e* and connected to the coil antenna 32. The coil terminal 33 as a whole has an L-shape when viewed from the side face. The wire of the coil constituting the coil antenna 32 is wound around the bobbin 25, that is, the outer circumference (between the front wall portion 14*b* and the rear wall portion 14*c*) of the outer cylindrical portion 14*a* of the front-portion constituent member 14. Each end (not illustrated) of the wire of the coil constituting the coil antenna 32 is led out from the bobbin 25 through the coil wire lead grooves 14*f* (indicated by a dotted line of FIG. 2A) formed in both side portions at the back end of the front-portion constituent member 14, and the end (not illustrated) of the wire is connected to the other end of each of the coil terminals 33 at both ends in the horizontal direction. One end (upper end) of the coil terminal 33 is inserted in a predetermined through-hole of the circuit board 40 and connected to a predetermined circuit conductor of the circuit board 40 by soldering.

As illustrated in FIGS. 2B, 6A, and 6B, the drain 14*g* in the substantially vertical direction is formed in the lower portion at the back end of the front-portion constituent member 14. The drain 14*g* is used to cause a liquid (such as rain water and juice) invading from the gap between the outer cylindrical portion 13*c* of the push button 13 and the outer cylindrical portion 14*a* of the front-portion constituent member 14 to flow down the lower portion on the rear side of the bobbin 25 through the inside of the bobbin 25 to drain away the liquid. The whole of the lower-end side of the drain 14*g* is surrounded with no gap by the lower-end portion of the rear wall portion 14*c*, a drain rear wall portion 14*h* extended downward from the lower portion at the back end of the inner cylindrical portion 14*d*, and a drain sidewall portion 14*j* (see FIGS. 6A and 6B) extended backward from both sides at the lower end of the rear wall portion 14*c*. The lower-end side of the drain 14*g* is separated from the region (between the front wall portion 14*b* and the rear wall portion 14*c*, that is, the inside of the bobbin 25) where the coil antenna 32 is disposed. As illustrated in FIGS. 3 and 2B, the upper-end side of the drain 14*g* is formed so as to pierce through a back-end-side coupling portion between the outer cylindrical portion 14*a* and the inner cylindrical portion 14*d*, the upper-end side of the drain 14*g* is communicated with a lower portion of a space between the outer cylindrical portion 14*a* and the inner cylindrical portion 14*d*, the water invading in the upper-end side of the drain 14*g* flows down to the drain 14*g* as illustrated by an arrow in FIG. 2B. That is, as illustrated in FIG. 2B, the upper surface of the upper-end portion of the drain 14*g* is covered with the lower portion of the inner cylindrical portion 14*d* of the front-portion constituent member 14, and the upper-end portion of the drain 14*g* is curved frontward and communicated with the inside of the bobbin 25.

As described above, as illustrated in FIGS. 2B, 7A, and 7B, the lower-end side of the drain 14*g* is joined to and communicated with the drain ports 11*c* that are formed in parallel in the lower portion of the first case 11 with no gap therebetween, the liquid flowing down to the drain 14*g* falls down to the lower portion of the switch device 10 and drained away from one of the drain ports 11*c*.

Accordingly, only the inner surface of each wall (the rear wall portion 14*c*, the drain rear wall portion 14*h*, the drain sidewall portion 14*j*, and the inner cylindrical portion 14*d*) surrounding the lower-end portion of the drain 14*g* can be visually recognized even if the person looks inside of the switch device 10 through the drain port 11*c* or the lower-end opening of the drain 14*g*, and the portion (the coil antenna 32, the coil terminal 33, the circuit board 40, and the switch bodies 41 and 42 in which the switch contact is incorporated) that is important from the viewpoint of security cannot be visually recognized from the drain port 11*c* or the lower-end opening of the drain 14*g*.

The front-face circumferential member 15 is a synthetic resin molded product, and the front-face circumferential member 15 is a ring member that decorates the outer circumference in the front surface of the switch device 10 (see FIG. 6C). The front-face circumferential member 15 is mounted such that the outer circumferential portion of the front wall portion 14*b* of the front-portion constituent member 14 and a front face and an outer circumferential surface of the flanges 11*a* and 12*a* formed in the outer circumferences at front ends of the first case 11 and second case 12 are covered with the front-face circumferential member 15. As illustrated in FIGS. 6A and 6C, the front-face circumferential member 15 includes latch pieces 15*a* at four points in the circumferential direction, and the latch pieces 15*a* are extended backward from the rear-face side. In the front-face circumferential member 15, as illustrated in FIG. 6A, a pawl (reference numeral is not given) formed toward the leading end of each latch piece 15*a* engages a rear-surface-side of the rear wall portion 14*c* of the front-portion constituent member 14. Therefore, the front-face circumferential member 15 is attached to the outer circumference of the front wall portion 14*b* or rear wall portion 14*c* of the front-portion constituent member 14, and the front-face circumferential member 15 is integral with the front-portion constituent member 14. In FIG. 6B, notches 14*x* and 14*y* are formed in the outer circumference of the front wall portion 14*b* or rear wall portion 14*c* of the front-portion constituent member 14 in order to fit the latch pieces 15*a* therein. As illustrated in FIGS. 6A and 6C, the latch pieces 15*a* and the notches 14*x* and 14*y* are disposed at positions that are different from the drain 14*g* in the circumferential direction. Therefore, the notches 14*x* and 14*y* are formed in a peripheral edge at the lower end of the drain 14*g* to prevent the generation of the gap through which the coil antenna 32 and the like can be visually recognized from the outside through the drain port 11*c*.

The slider 16 is a synthetic resin molded product, and the slider 16 includes a cylindrical portion 16*a* and a plate-like portion 16*b*. The front-end portion of the cylindrical portion 16*a* is mounted in the inner cylindrical portion 13*b* of the push button 13. The plate-like portion 16*b* is formed so as to be extended backward from the lower portion at the back end of the cylindrical portion 16*a*. As illustrated in FIG. 1B, the plate-like portion 16*b* of the slider 16 has a rectangular outer shape as a whole when viewed from the upper surface, and the plate-like portion 16*b* of the slider 16 is mounted on the bottom surface of the first case 11 while being slidable in the front-back direction with respect to the first case 11.

Stopper openings 16*c* are formed on both sides in the horizontal direction in the back-end portion of the plate-like portion 16*b* of the slider 16 while piercing vertically through the back-end portion of the plate-like portion 16*b*. An upper-end portion of a stopper portion 17*b* of the lower plate 17 is inserted in the stopper opening 16*c*. In the assembled state of the switch device 10, a range where the slider 16 and the push button 13 integrated therewith move in the front-back direction is controlled within a predetermined range by abutment between inner end faces in the front-back direction of the stopper opening 16*c* and the upper-end portion of the stopper portion 17*b*. The predetermined range means a range from the position of the neutral state (non-manipulated state) of FIG. 3 to the position in the full-stroke state of FIG. 4.

Inclined surfaces 35 and 36 are formed at positions (position in front of the stopper opening 16*c* on the left side) on the left side in the upper surface of the plate-like portion 16*b*. The inclined surfaces 35 and 36 are inclined with respect to a predetermined direction (in this case, the front-back direction) in which the slider 16 moves, and the inclined surfaces 35 and 36 can come into contact with pressing manipulation portions 41*a* and 42*a* described below (see FIG. 3). The inclined surface 35 and 36 are formed in parallel in the front-back direction, the front-side inclined surface 35 comes into contact with the pressing manipulation portion 41*a* of the front-side switch body 41, and the back-side inclined surface 36 comes into contact with the pressing manipulation portion 42*b* of the back-side switch body 42. In this case, the inclined surface 35 is downwardly inclined in the backward direction, and the inclined surface 35 has a positively inclined surface inclined toward an orientation in which the pressing manipulation portion 41*a* retreats in activating the switch device 10. On the other hand, the inclined surface 36 is upwardly inclined in the backward direction, and the inclined surface 36 has a reversely inclined surface inclined toward an orientation in which the pressing manipulation portion 42*a* advances in activating the switch device 10.

As illustrated in FIGS. 1B and 5, a recessed chamber 16*d* in which the return spring 18 is disposed is formed on the bottom surface side at a central position in the horizontal direction in the back-end portion of the plate-like portion 16*b* of the slider 16. A projection 16*e* (see FIG. 5, neglected in FIG. 1) projected backward is formed in the inner end face in front of the recessed chamber 16*d*. The leading-end portion of the return spring 18 is mounted on the outer circumference of the projection 16*e*, whereby the leading-end portion of the return spring 18 is positioned and retained.

As illustrated in FIG. 5, a boss 16*f* projected upward is formed at the central position in the horizontal direction on the relatively front side of the plate-like portion 16*b* of the slider 16. As illustrated in FIG. 5, a cylindrical recessed chamber 16*g* opened onto the bottom surface side is formed in the boss 16*f*, and a crisp feel spring 19 and a crisp feel ball 20 are sequentially loaded in the cylindrical recessed chamber 16*g*.

As described above, the guide grooves 16*m* are formed in the side faces on both sides of the plate-like portion 16*b* of the slider 16 over the substantially total length of the plate-like portion 16*b* (see FIG. 1B), the guide projections 11*t* that are slidably fitted in the guide grooves 16*m* are provided at the two positions in the front-back direction in the internal surface of the first case 11, and the guide projection 11*t* and the guide groove 16*m* constitute the guiding mechanism. Although not illustrated, the similar guiding mechanism is provided between the bottom surface of the slider 16 and the bottom surface of the first case 11. In this case, the back end of the guide groove 16*m* is obviously opened backward such that the slider 16 can be mounted therein.

After the return spring 18 is mounted on the slider 16, the slider 16 is inserted in a pressing manipulation direction (the right in FIG. 5) against the biasing force of the return spring 18 and mounted in the first case 11, while the guide projection 11*t* corresponding to each guide groove 16*m* is fitted from the front side (left side in FIG. 5) of the first case 11. Therefore, the slider 16 is assembled in the first case 11 while being movable only in the front-back direction.

In order to avoid interference with the stopper portion 17*b* of the lower plate 17, the slider 16 is mounted on the first case 11 with the above-described assembly structure before the lower plate 17 is mounted on the first case 11.

As illustrated in FIG. 2B, the temporarily-jointing engagement projection 16*k* that can engage with the temporarily-jointing engagement projection 11*k* is formed at a relatively right-front-side position in the bottom surface of the plate-like portion 16*b* of the slider 16.

However, when the slider 16 is assembled in the first case 1, the temporarily-jointing engagement projection 11*k* and the temporarily-jointing engagement projection 16*k* elastically deform so as not to engage each other, which allows the slider 16 to be assembled in the above-described manner. Therefore, in the temporarily-jointing engagement projection 11*k* and the temporarily-jointing engagement projection 16*k*, the surfaces that come into contact with each other in assembling the slider 16 become the inclined surfaces as illustrated in FIG. 2B, and the surfaces become the small projections that can cross over each other with a slight deformation (including a deformation of each projection and deflection of surrounding portion) in assembling the slider 16.

The lower plate 17 is a synthetic resin molded product. As illustrated in FIGS. 5, 7A and 7B, the lower plate 17 is mounted from below on the bottom surface of the first case 11 so as to be integral with the first case 11. Only the lower plate 17 is detachably attached to the first case 11 while the return spring 18 and the slider 16 are assembled in the first case 11 (however, the second case 12 is detached). As illustrated in FIG. 7A, when the lower plate 17 is viewed from the bottom surface, the central portion in the horizontal direction of the lower plate 17 is elongated frontward, and the back-end portion of the lower plate 17 is horizontally extended, and the lower plate 17 has a substantial T-outer-shape as a whole. The upper surface side in the frontward-extended front-end portion of the lower plate 17 is fitted in the opening 11*d* of the first case 11, and the upper surface comes into contact with the crisp feel ball 20, thereby constituting the ball contact portion 17*a*. As illustrated in FIGS. 3 and 8, the stopper portions 17*b* are formed at both ends in the horizontal direction at two positions of the back-end portion of the lower plate 17, and each stopper portion 17*b* is fitted in the opening 11*e* of the first case 11.

The stopper portions 17*b* constitute the stopper that controls a movement range of the slider 16, and the stopper portions 17*b* are projected upward from both ends in the horizontal direction of the back-end portion of the lower plate 17 and inserted in the stopper openings 16*c* formed in the slider 16. When the slider 16 is located at a non-manipulated position, the stopper portion 17*b* abut on the inner end face on the back side of the stopper opening 16*c*, and the stopper portion 17*b* engages the slider 16, thereby preventing the slider 16 from moving in the return direction (in this case, frontward direction) beyond the non-manipulated position. In this embodiment, the stopper portion 17*b* also controls the stroke in the pressing manipulation direction (in this case, backward direction) of the slider 16. That is, in the full-stroke state in which the push button 13 is pushed down to backwardly move the slider 16 to the full stroke, as illustrated in FIG. 4, the stopper portion 17*b* abuts on the inner end face on the front side of the stopper opening 16*c*, and the stopper portion 17*b* engages the slider 16, thereby preventing the slider 16 from moving in the pressing manipulation direction (in this case, the backward direction) beyond the position of the full-stroke state.

As described above, the return spring 18 is the coil spring mounted between the rear portion of the slider 16 and the partition wall 11*f* of the first case 11, and the return spring 18 acts as the biasing member that biases the slider 16 toward the non-manipulated position (in this case, frontward direction).

The crisp feel generating mechanism 21 includes the crisp feel spring 19, the crisp feel ball 20, and a ball contact portion 17*a*. The crisp feel ball 20 is always pushed downward by the biasing force of the crisp feel spring 19, and the crisp feel ball 20 is pressed against the upper surface of the ball contact portion 17*a*. The crisp feel ball 20 moves in the front-back direction along with the slider 16, while the ball contact portion 17*a* integral with the first case 11 does not move in the front-back direction. The upper surface of the ball contact portion 17*a* is raised into a substantial chevron shape, and the crisp feel ball 20 is in press contact with a position slightly in front of an apex position raised in the upper surface of the ball contact portion 17*a* in the neutral state in which the push button 13 or the slider 16 is located at the non-manipulated position (see FIGS. 3 and 5). In the activated state in which the slider 16 moves from the non-manipulated position beyond a predetermined activated position (for example, a position at which the slider 16 is pushed down by 1.2 mm from the non-manipulated position), it is necessary that the crisp feel ball 20 crosses over the apex position of the ball contact portion 17*a* while compressing the crisp feel spring 19. In this case, a resistance force is generated in the slider 16 by compressing the crisp feel spring 19, and the resistance force generates a crisp feel. The shape of the upper surface of the ball contact portion 17*a* is set such that magnitude of the resistance force becomes a peak (maximum) at the position slightly in front of the activated position (for example, the position at which the slider 16 is pushed down by 1.0 mm from the non-manipulated position).

The connector 31 electrically connects the switch device 10 and an external device (for example, a vehicle engine controller or an in-vehicle controller for immobilizer). The connector 31 and the predetermined circuit conductor of the circuit board 40 are connected by L-shape terminals 31*a* and 31*b* of FIG. 5. The L-shape terminals 31*a* and 31*b* are extended from the front end of the connector 31, and leading ends of the L-shape terminals 31*a* and 31*b* are soldered while inserted in the through-holes of the circuit board 40.

As described above, the coil antenna 32 is formed by winding the coil wire (lead whose surface is covered with insulating material) around the outer circumference (between the front wall portion 14*b* and the rear wall portion 14*c*) of the outer cylindrical portion 14*a* of the front-portion constituent member 14. The coil antenna 32 is connected to the predetermined circuit conductor of the circuit board 40 through the coil terminal 33. The coil antenna 32 is used as an emergency antenna when the normal wireless communication for verification cannot be conducted between the electronic key and the antenna of the in-vehicle controller for immobilizer due to the consumed battery for the immobilizer electronic key. When the user brings the electronic key close to the push button 13 (that is, close to the coil antenna 32), the coil antenna 32 is operated by electric power transfer of an electromagnetic wave transmitted from the coil antenna 32, and the wireless communication for verification is conducted between the electronic key and the coil antenna 32. When the verification result is affirmative, the starting of the engine is permitted.

The switch bodies 41 and 42 and the like are mounted on the circuit board 40. A drive circuit of the coil antenna 32 may be formed on the circuit board 40. The circuit board 40 is disposed so as to close the upper surface of the first case 11 while a board surface is parallel to the front-back direction and orthogonal to the vertical direction. The circuit board 40 is fixed to the first case 11 and the connector 31 by a latch portion (not illustrated) or a screw.

In FIG. 5, a light-emitting portion 37 is formed by a light-emitting element mounted on the bottom surface side in the front portion of the circuit board 40. The light-emitting portion 37 emits light to the push button 13 from the backside to illuminate the push button 13, thereby notifying the user of the position of the push button 13.

The switch bodies 41 and 42 are module type switches, and the switch bodies 41 and 42 are, for example, so-called detection switch (or micro switch). The switch bodies 41 and 42 include pressing manipulation portions 41*a* and 42*a* (see FIG. 3), respectively. The pressing manipulation portions 41*a* and 42*a* can move in retreating and advancing directions so as to emerge and disappear, and the pressing manipulation portions 41*a* and 42*a* are biased in a forward direction (in this case, downwardly-projected direction). Switch contacts are incorporated in the switch bodies 41 and 42, and on and off states of the switch contact are switched by the retreating and advancing movements of each of the pressing manipulation portions 41*a* and 42*a*. As illustrated in FIG. 7C, for example, the switch bodies 41 and 42 include contact terminals A, B, and C, the switch bodies 41 and 42 become a non-activated state in which the electric conduction is established between the common terminal C and the normally closed terminal B when the pressing manipulation portions 41*a* and 42*a* are not pushed down, and the switch bodies 41 and 42 become an activated state in which the electric conduction is established between the common terminal C and the normally closed terminal A when the pressing manipulation portions 41*a* and 42*a* are pushed down to at least a predetermined amount. In this case, the vehicle engine starting controller and the like connected to the switch device 10 through the connector 31 reads the switching operation of the contacts of the switch bodies 41 and 42 to determine that an instruction of starting or stopping the engine is provided.

As illustrated in FIG. 3, the switch bodies 41 and 42 are mounted on the bottom surface side of the circuit board 40, and the switch bodies 41 and 42 are placed such that the retreating and advancing directions of each of the pressing manipulation portions 41*a* and 42*a* intersect the front-back direction.

In the neutral state in which the push button 13 or the slider 16 is located at the non-manipulated position (see FIG. 3), the pressing manipulation portion 41*a* of the switch body 41 becomes a state in which the pressing manipulation portion 41*a* advances at a maximum while not being in press contact with the inclined surface 35 (that is, the pressing manipulation portion 41*a* advances downward at a maximum, and the contact is in the non-activated state). When the push button 13 or the slider 16 is further pushed down to the back of the non-manipulated position, the pressing manipulation portion 41*a* comes into press contact with the inclined surface 35 to start the retreating operation (that is, upwardly-pushed operation is started). When the push button 13 or the slider 16 is pushed down to the activated state, the pressing manipulation portion 41*a* retreats to the position at which the state of the contact of the switch body 41 is switched from the non-activated state to the activated state.

In the neutral state, the pressing manipulation portion 42*a* of the switch body 42 becomes a state in which the pressing manipulation portion 42*a* comes into press contact with the inclined surface 36 to retreat at a maximum (that is, pushed down at a maximum, and the contact is in the activated state). When the push button 13 or the slider 16 is pushed down at the back of the non-manipulated position, the pressing manipulation portion 42*a* comes into press contact with the inclined surface 36 to start the advancing operation (that is, downwardly-projected advancing operation is started). When the push button 13 or the slider 16 is pushed down to the activated state, the pressing manipulation portion 42*a* advances to the position at which the state of the contact of the switch body 42 is switched from the activated state to the non-activated state.

In the switch device 10, in the neutral state in which the user does not press the push button 13, the slider 16 of FIG. 3 is retained at the non-manipulated position (position at which the upper-end portion of the stopper portion 17*b* abuts on the end face on the back side of the stopper opening 16*c*) by the biasing force of the return spring 18. Therefore, because the switch body 41 is in the non-activated state while the switch body 42 is in the activated state, the instruction of starting or stopping the vehicle engine is not provided (that is, the controller side does not determine that the instruction of starting or stopping the vehicle engine is provided).

When the user performs the manipulation for backwardly pushing down the push button 13 against the biasing force of the return spring 18 or the resistance force of the crisp feel generating mechanism 21 to push down the push button 13 or the slider 16 at the back of the activated position, the inclined surface 35 and 36 come into contact with the pressing manipulation portions 41*a* and 42*a* of the switch bodies 41 and 42 to move the pressing manipulation portions 41*a* and 42*a* in the advancing and retreating directions, thereby switching the on and off states of the switch contacts of the switch bodies 41 and 42 (in this case, the switch body 41 becomes the activated state while the switch body 42 becomes the non-activated state). Therefore, the instruction of starting or stopping the vehicle engine is provided (that is, the controller side determines that the instruction of starting or stopping the vehicle engine is provided).

When the user performs the manipulation for backwardly pushing down push button 13, usually the push button 13 or the slider 16 moves tentatively to the full stroke state. In the full-stroke state, the upper-end portion of the stopper portion 17*b* abuts on the inner end face on the front side of the stopper opening 16*c* to prevent the push button 13 or the slider 16 from moving backward.

The in-vehicle controller side may determine the instruction based on an AND condition of the operations of the contacts of the switch bodies 41 and 42 or an OR condition. That is, the in-vehicle controller side may determine that the instruction is provided when both the states of the contacts of the switch bodies 41 and 42 (specifically, the state of a signal such as a voltage corresponding to the state of the contact) are properly changed, or the in-vehicle controller side may determine that the instruction is provided when one of the states of the contacts of the switch bodies 41 and 42 is properly changed. However, in order that the instruction of the vehicle engine starting is securely provided even if one of the switch bodies 41 and 42 breaks down, desirably the in-vehicle controller side determines that the instruction is provided when one of the states of the contacts of the switch bodies 41 and 42 is properly changed (that is, the contact of the switch body 41 is changed from the non-activated state to the activated state, or the contact of the switch body 42 is changed from the activated state to the non-activated state).

Thus, in the switch device 10, the instruction of starting or stopping the engine can be provided with high reliability by the switch bodies 41 and 42.

Further, in the switch device 10 of this embodiment, the coil bobbin 25 is formed in the outer circumference of the front-portion constituent member 14, the drain 14*g* is formed in the front-portion constituent member 14 in order that the liquid invading from the gap between the outer circumference of the push button 13 and the front-portion constituent member 14 is caused to flow down to the lower portion on the rear side of the bobbin 25 through the inside of the bobbin 25, and the drain port 11*c* is formed on the bottom surface side of the case (first case 11) while connected to the lower-end opening of the drain 14*g* with no gap therebetween. Therefore, because the switch device 10 has the structure in which at least the coil 32 cannot be visually recognized from the drain port 11*c*, the security degradation caused by visually recognizing the coil 32 from the outside of the switch device 10 can be avoided while the drain property of the liquid invading from the gap of the outer circumference of the push button 13 is maintained. In switch device 10, the circuit board 40 is provided in the case (including the first case 11 and the second case 12), the switch contacts are incorporated in the switch bodies 41 and 42, and the coil 32 is connected to the circuit board 40. The circuit board 40 and the switch bodies 41 and 42 (including the switch contacts) cannot be visually recognized from the drain port 11*c*. Therefore, the security degradation caused by visually recognizing the circuit board 40 or the switch contact from the outside of the switch device 10 can be avoided.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch device comprising:

a slider that advances and retreats in a front-back direction;

a push button that is integrally provided at a front end of the slider;

a switch contact whose on and off states are switched according to an operation for pushing down the push button to cause the slider to retreat;

a biasing member that biases the slider in an advancing direction in order to return the push button and the slider to a non-manipulated position;

a case in which the switch contact, the biasing member, and the slider are assembled, the push button being disposed in an opening at a front end of the case;

a front-portion constituent member that is attached to the case while disposed around the push button in the opening; and a coil that is wound around a bobbin formed in an outer circumference of the front-portion constituent member, wherein a drain that causes a liquid to flow down to a lower portion on a rear side of the bobbin through an inside of the bobbin is formed in the front-portion constituent member, the liquid invading from a gap between an outer circumference of the push button and the front-portion constituent member, and a drain port that is joined to and communicated with a lower-end opening of the drain with no gap therebetween is formed on a bottom surface side of the case, and at least the coil cannot be visually recognized from the drain port.

2. The switch device according to claim 1, wherein a circuit board to which the switch contact and the coil are connected is provided in the case, and the circuit board and the switch contact cannot be visually recognized from the drain port.

* * * * *